US005878542A

United States Patent [19]

Cornelius

[11] Patent Number: 5,878,542

[45] Date of Patent: Mar. 9, 1999

[54] LOG SIDING

[76] Inventor: Melissa D. Cornelius, 177 E 100 N, Spanish Fork, Utah 84660

[21] Appl. No.: 992,497

[22] Filed: Dec. 17, 1997

[51] Int. Cl.[6] ..... E04D 1/00; E04B 1/10

[52] U.S. Cl. ..... 52/519; 52/520; 52/233

[58] Field of Search ..... 52/519, 520, 233

[56] References Cited

U.S. PATENT DOCUMENTS

| | | | |
|---|---|---|---|
| 5,074,093 | 12/1991 | Meadows | 52/520 |
| 5,181,358 | 1/1993 | Mead | 52/233 |
| 5,423,153 | 6/1995 | Woolems et al. | 52/233 |
| 5,586,422 | 12/1996 | Hoffner | 52/233 |

*Primary Examiner*—Carl D. Friedman
*Assistant Examiner*—Dennis L. Dorsey

[57] ABSTRACT

A new log siding for installing on a structure to simulate an appearance of a log cabin. The inventive device includes a plurality of longitudinal sections adapted for coupling together in a side by side orientation and an end to end orientation on a wall of a structure. Each of the longitudinal sections has an arcuate central portion. The arcuate central portion has an upper edge extending upwardly therefrom. The upper edge has a downturned end portion forming a receiving slot. The arcuate central portion has a lower edge extending downwardly therefrom. The lower edge has an upturned portion on an intermediate portion thereof. The upturned portion has a slot formed therein. The lower edge has a plurality of apertures therethrough disposed below the upturned portion. The arcuate central portion has indicia thereon resembling a log. A plurality of corner posts are adapted for coupling with the longitudinal sections at corners of the structure. The corner posts each have a central section with receiving slots formed on opposing ends thereof. The receiving slots are dimensioned for receiving the lower edges of the longitudinal sections therein.

1 Claim, 4 Drawing Sheets

LOG SIDING

BACKGROUND OF THE INVENTION

1. Field of the Invention

The present invention relates to simulated log cabins and more particularly pertains to a new log siding for installing on a structure to simulate an appearance of a log cabin.

2. Description of the Prior Art

The use of simulated log cabins is known in the prior art. More specifically, simulated log cabins heretofore devised and utilized are known to consist basically of familiar, expected and obvious structural configurations, notwithstanding the myriad of designs encompassed by the crowded prior art which have been developed for the fulfillment of countless objectives and requirements.

Known prior art simulated log cabins include U.S. Pat. No. 5,181,358 to Mead; U.S. Pat. No. 4,288,954 to O'Donnell; U.S. Pat. No. 4,433,519 to Jenkins; U.S. Pat. No. 5,271,878 to Mizia et al.; U.S. Pat. No. 5,423,153 to Woolems et al.; and U.S. Pat. No. 4,450,665 to Katz.

While these devices fulfill their respective, particular objectives and requirements, the aforementioned patents do not disclose a new log siding. The inventive device includes a plurality of longitudinal sections adapted for coupling together in a side by side orientation and an end to end orientation on a wall of a structure. Each of the longitudinal sections has an arcuate central portion. The arcuate central portion has an upper edge extending upwardly therefrom. The upper edge has a downturned end portion forming a receiving slot. The arcuate central portion has a lower edge extending downwardly therefrom. The lower edge has an upturned portion on an intermediate portion thereof. The upturned portion has a slot formed therein. The lower edge has a plurality of apertures therethrough disposed below the upturned portion. The arcuate central portion has indicia thereon resembling a log. A plurality of corner posts are adapted for coupling with the longitudinal sections at corners of the structure. The corner posts each have a central section with receiving slots formed on opposing ends thereof. The receiving slots are dimensioned for receiving the lower edges of the longitudinal sections therein.

In these respects, the log siding according to the present invention substantially departs from the conventional concepts and designs of the prior art, and in so doing provides an apparatus primarily developed for the installing on a structure to simulate an appearance of a log cabin.

SUMMARY OF THE INVENTION

In view of the foregoing disadvantages inherent in the known types of simulated log cabins now present in the prior art, the present invention provides a new log siding construction wherein the same can be utilized for installing on a structure to simulate an appearance of a log cabin.

The general installing on a structure to simulate an appearance of a log cabin of the present invention, which will be described subsequently in greater detail, is to provide a new log siding apparatus and method which has many of the advantages of the simulated log cabins mentioned heretofore and many novel features that result in a new log siding which is not anticipated, rendered obvious, suggested, or even implied by any of the prior art simulated log cabins, either alone or in any combination thereof.

To attain this, the present invention generally comprises a plurality of starter portions coupled to a top of a wall of a structure for starting a vertical row. The starter portions each have a planar base having a plurality of apertures through a lower section thereof. The planar base has an upturned section extending outwardly thereof. The upturned section has receiving slot formed therein. A plurality of longitudinal sections are adapted for coupling together in a side by side orientation and an end to end orientation on the wall of the structure. Each of the longitudinal sections has an arcuate central portion. The arcuate central portion has an upper edge extending upwardly therefrom. The upper edge has a downturned end portion forming a receiving slot. The arcuate central portion has a lower edge extending downwardly therefrom. The lower edge has an upturned portion on an intermediate portion thereof. The upturned portion has a slot formed therein. The lower edge has a plurality of apertures therethrough disposed below the upturned portion. The arcuate central portion has indicia thereon resembling a log. A plurality of corner posts are adapted for coupling with the longitudinal sections at corners of the structure. The corner posts each have an arcuate central section with receiving slots formed on opposing ends thereof. The receiving slots are dimensioned for receiving the lower edges of the longitudinal sections therein. A plurality of arcuate metal members are disposed over a seam formed when the longitudinal sections are disposed in the end to end orientation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the installing on a structure to simulate an appearance of a log cabin of description and should not be regarded as limiting.

As such, those skilled in the art will appreciate that the conception, upon which this disclosure is based, may readily be utilized as a basis for the designing of other structures, methods and systems for carrying out the several installing on a structure to simulate an appearance of a log cabins of the present invention. It is important, therefore, that the claims be regarded as including such equivalent constructions insofar as they do not depart from the spirit and scope of the present invention.

Further, the installing on a structure to simulate an appearance of a log cabin of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new log siding apparatus and method which has many of the advantages of the simulated log cabins mentioned heretofore and many novel features that result in a new log siding which is not anticipated, rendered obvious, suggested, or even implied by any of the prior art simulated log cabins, either alone or in any combination thereof.

It is another object of the present invention to provide a new log siding which may be easily and efficiently manufactured and marketed.

It is a further object of the present invention to provide a new log siding which is of a durable and reliable construction.

An even further object of the present invention is to provide a new log siding which is susceptible of a low cost of manufacture with regard to both materials and labor, and which accordingly is then susceptible of low prices of sale to the consuming public, thereby making such log siding economically available to the buying public.

Still yet another object of the present invention is to provide a new log siding which provides in the apparatuses and methods of the prior art some of the advantages thereof, while simultaneously overcoming some of the disadvantages normally associated therewith.

Still another object of the present invention is to provide a new log siding for installing on a structure to simulate an appearance of a log cabin.

Yet another object of the present invention is to provide a new log siding which includes a plurality of longitudinal sections adapted for coupling together in a side by side orientation and an end to end orientation on a wall of a structure. Each of the longitudinal sections has an arcuate central portion. The arcuate central portion has an upper edge extending upwardly therefrom. The upper edge has a downturned end portion forming a receiving slot. The arcuate central portion has a lower edge extending downwardly therefrom. The lower edge has an upturned portion on an intermediate portion thereof. The upturned portion has a slot formed therein. The lower edge has a plurality of apertures therethrough disposed below the upturned portion. The arcuate central portion has indicia thereon resembling a log. A plurality of corner posts are adapted for coupling with the longitudinal sections at corners of the structure. The corner posts each have a central section with receiving slots formed on opposing ends thereof. The receiving slots are dimensioned for receiving the lower edges of the longitudinal sections therein.

Still yet another object of the present invention is to provide a new log siding that is installed in the same manner as standard aluminum siding.

Even still another object of the present invention is to provide a new log siding that is provided in different shapes and is elaborately designed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
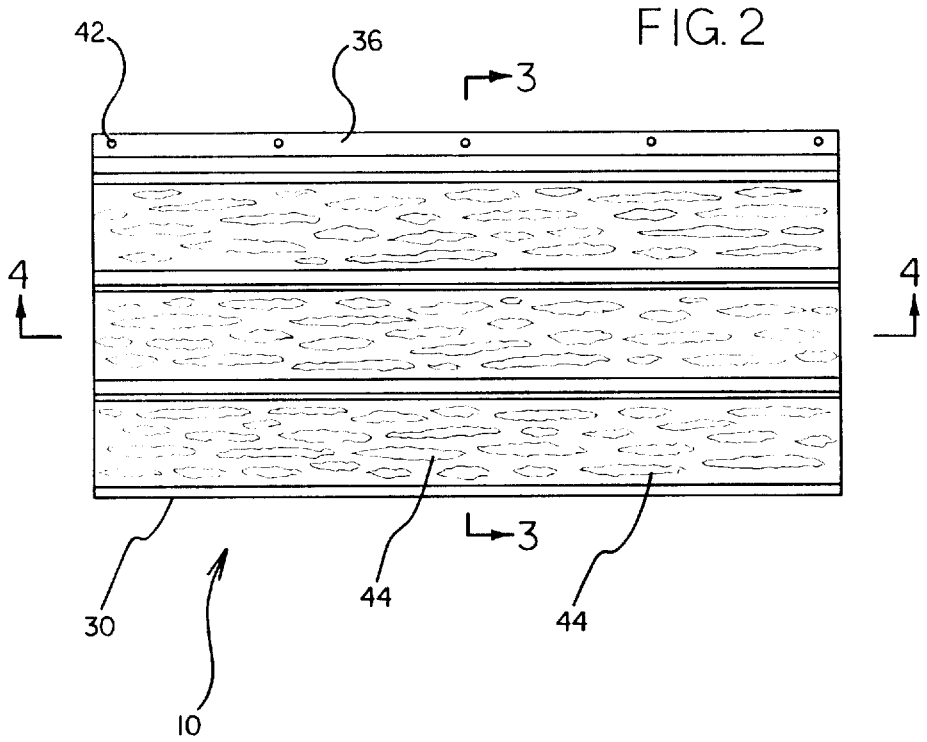
FIG. 2 is a front elevation view of a section of coupled sidings of the present invention.
Figure 1:
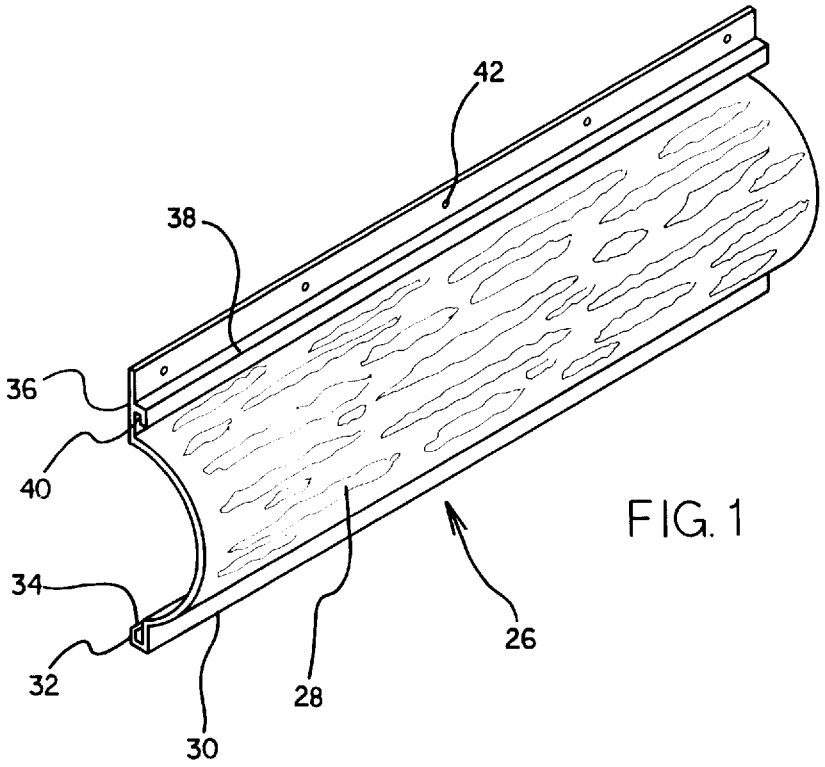
FIG. 1 is a perspective view of a new log siding according to the present invention.
Figure 4:
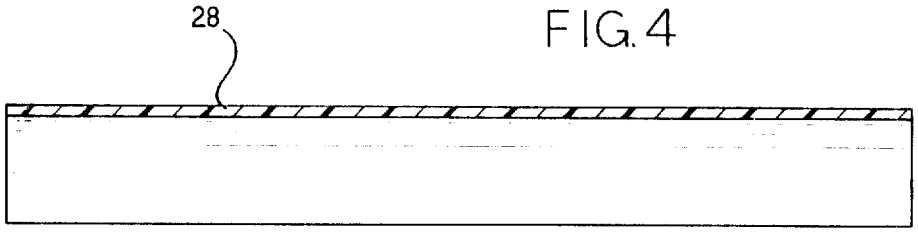
FIG. 4 is a cross-sectional view of the present invention as taken along line 4—4 of FIG. 2.
Figure 3:
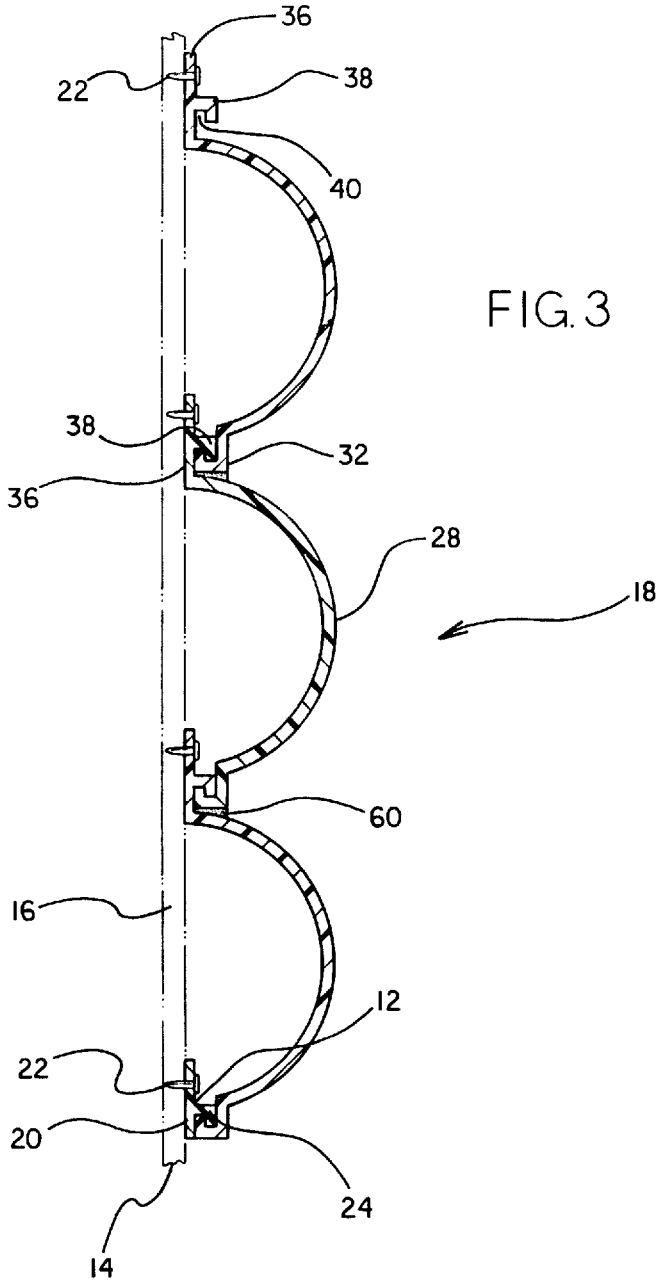
FIG. 3 is a cross-sectional view of the present invention as taken along line 3—3 of FIG. 2.
Figure 5:
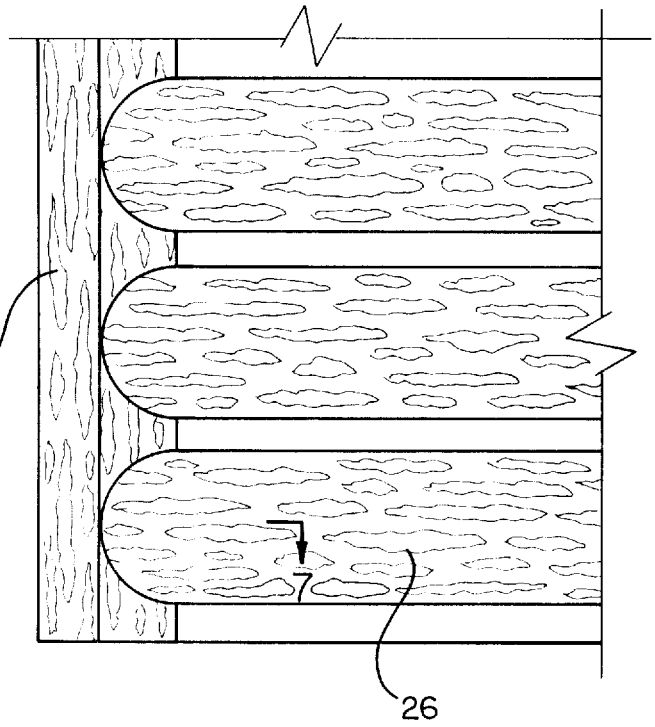
FIG. 5 is a front sectional view of the present invention illustrated with a round corner post.
Figure 6:
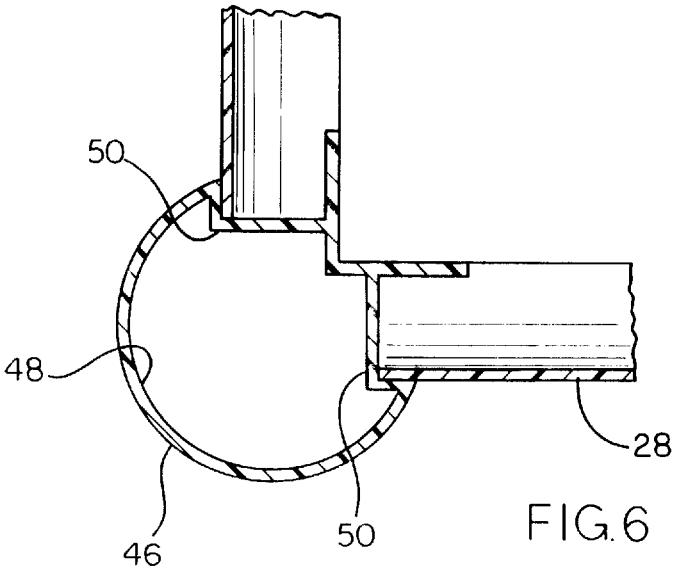
FIG. 6 is a cross-sectional view of the present invention.
Figure 7:
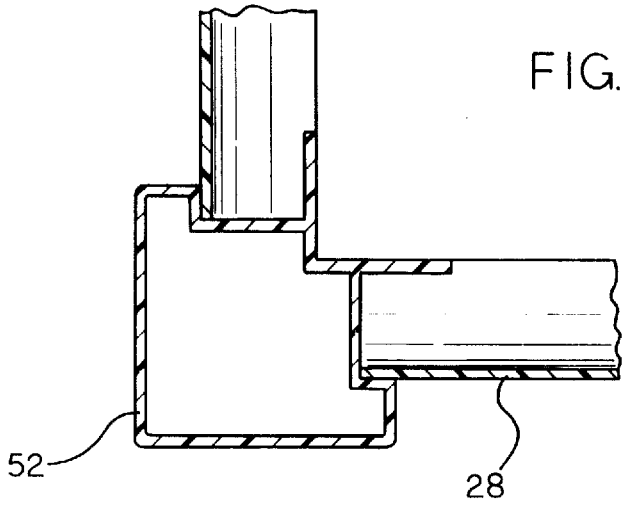
FIG. 7 is a cross-sectional view of the present invention utilizing a square corner post.
Figure 8:
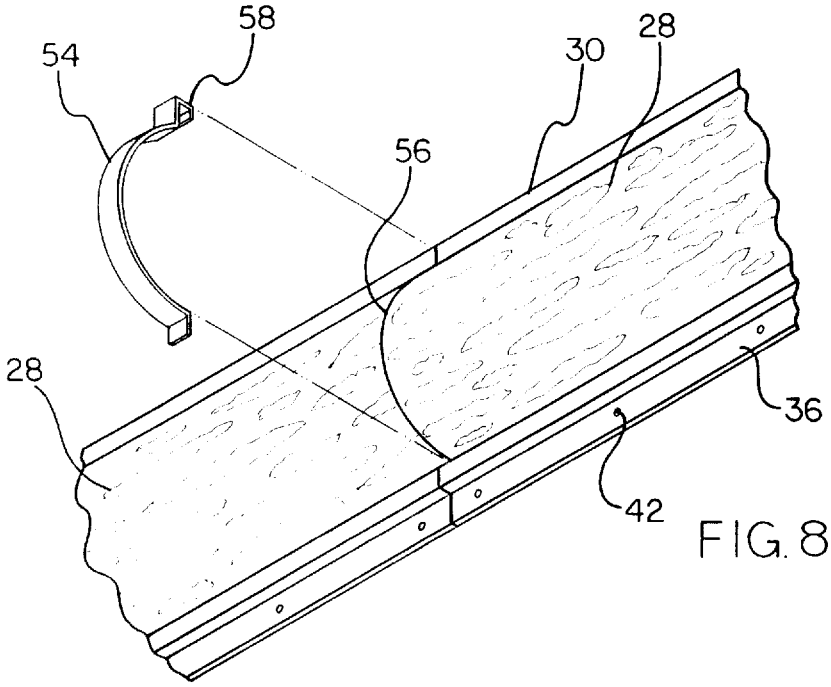
FIG. 8 is a perspective view of side by side sections of siding with an arcuate metal member disposed over the seam.

With reference now to the drawings, and in particular to FIGS. 1 through 8 thereof, a new log siding embodying the principles and concepts of the present invention and generally designated by the reference numeral 10 will be described.

As best illustrated in FIGS. 1 through 8, the log siding 10 comprises a plurality of starter portions 12 coupled to a top 14 of a wall 16 of a structure for starting a vertical row 18. The starter portions 12 each have a planar base 20 having a plurality of apertures through a lower section thereof. The plurality of apertures permit nails or other fasteners 22 to extend therethrough for securement of the starter portions 12 to the wall 16. The planar base 20 has an upturned section 24 extending outwardly thereof. The upturned section 24 has receiving slot formed therein.

A plurality of longitudinal sections 26 are adapted for coupling together in a side by side orientation (FIG. 3) and an end to end orientation (FIG. 8) on the wall 16 of the structure. Each of the longitudinal sections 26 has an arcuate central portion 28. The arcuate central portion 28 has an upper edge 30 extending upwardly therefrom. The upper edge 30 has a downturned end portion 32 forming a receiving slot 34. The arcuate central portion 28 has a lower edge 36 extending downwardly therefrom. The lower edge 36 has an upturned portion 38 on an intermediate portion thereof. The upturned portion 38 has a slot 40 formed therein. The lower edge 36 has a plurality of apertures 42 therethrough disposed below the upturned portion 38. The apertures 42 allow for a nail or other fastener 22 to extend therethrough for securement of the longitudinal sections 26 to the wall 16. The arcuate central portion 28 has indicia 44 thereon resembling a log.

A plurality of corner posts 46 are adapted for coupling with the longitudinal sections 26 at corners of the structure. The corner posts 46 each have an arcuate central section 48 with receiving slots 50 formed on opposing ends thereof. The receiving slots 50 are dimensioned for receiving the lower edges of the longitudinal sections 26 therein. Note FIGS. 5 and 6. Alternately, square corner posts 52 could be provided. Note FIG. 7.

A plurality of arcuate metal members 54 are disposed over a seam 56 formed when the longitudinal sections 26 are disposed in the end to end orientation. Note FIG. 8. The arcuate metal members 54 include a downturned upper edge 58 for engaging the upper edge of the longitudinal sections 26.

In use, the starter portions 12 are placed around the top of the wall 16 of the structure with nails or the like hammered through the apertures. The downturned portion 32 of the upper edge of the longitudinal members 26 are engaged to the upturned section 24 of the starter portions in the respective receiving slots thereof. A sealant is then used to permanently secure the longitudinal member 26 to the starter portion 12. Nails or other fasteners are then hammered through the plurality of apertures 42. The downturned portion 32 of the upper edge of a next longitudinal member 26 is engaged to the upturned portion 38 of the lower edge of the longitudinal member 26 positioned thereabove. A sealant 60 is then used to permanently secure the respective edges of the longitudinal members together. This process is continued until a vertical row is completed whereafter the next row is started. When the two rows are completed. The arcuate metal members 56 are positioned over the seams 56 between the end to end oriented longitudinal members. Once all of the walls of the structure have been cover, the corner posts 46 are then put in place on where the corners of the structure are left exposed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A log siding system for simulating a log cabin appearance comprising, in combination:

a plurality of starter portions coupled to a top of a wall of a structure for starting a vertical row, the starter portions each having a planar base having a plurality of apertures through a lower section thereof for allowing the passage of fasteners therethrough, the planar base having an upturned section extending outwardly thereof, the upturned section having a U-shaped cross-section defining a receiving slot formed therein;

a plurality of longitudinal sections adapted for coupling together in a side by side orientation and an end to end orientation on the wall of the structure, each of the longitudinal sections having an arcuate central portion with a semi-circular cross-section, the arcuate central portion having an upper edge extending upwardly therefrom, the upper edge having a downturned end portion having a U-shaped cross-section along a length thereof defined by a planar vertical exterior extent a planar horizontal intermediate extent and a planar vertical interior extent with a size equal to that of the intermediate extent of the downturned portion and ½ that of the exterior extent of the downturned portion for forming a receiving slot, the arcuate central portion having a lower edge extending downwardly therefrom, the lower edge having an upturned portion along a center line thereof, the upturned portion having a U-shaped cross-section along a length thereof defined by a planar vertical interior extent a planar horizontal intermediate extent and a planar vertical exterior extent with a size equal to that of the intermediate extent of the upturned portion and ½ that of the interior extent of the upturned portion for defining a slot therein, the lower edge having an extension extending past the upturned portion with a plurality of apertures therethrough disposed below the upturned portion, the arcuate central portion having indicia thereon resembling a log, wherein the upturned portion of each longitudinal section is fittedly engagable with the downturned portion of an adjacent longitudinal section such that the extension resides within the arcuate central portion of the adjacent longitudinal section;

a sealent positioned between each of the longitudinal sections for affording a seal therebetween;

a plurality of corner posts adapted for coupling with the longitudinal sections at corners of the structure, the corner posts each having a central section including an exterior surface and an interior surface to define a hollow inner space with the interior surface having receiving slots formed on opposing ends thereof, the receiving slots being defined by recesses formed in the interior surface with a right angle extensions formed thereon for fitting about one of the corners of the structure, each slot being dimensioned for receiving the longitudinal sections therein; and a plurality of arcuate metal members disposed over a seam formed when the longitudinal sections are disposed in the end to end orientation, each arcuate metal member having a planar lower edge and downturned upper edge with a U-shaped cross-section for engaging the upper edge of one of the longitudinal sections.

* * * * *